US011166560B2

(12) United States Patent
Chen

(10) Patent No.: US 11,166,560 B2
(45) Date of Patent: Nov. 9, 2021

(54) HEADREST DEVICE OF OFFICE CHAIR

(71) Applicant: Yi-Ru Chen, Taichung (TW)

(72) Inventor: Yi-Ru Chen, Taichung (TW)

( * ) Notice: Subject to any disclaimer, the term of this patent is extended or adjusted under 35 U.S.C. 154(b) by 0 days.

(21) Appl. No.: 16/660,805

(22) Filed: Oct. 23, 2019

(65) Prior Publication Data

US 2020/0146452 A1 May 14, 2020

(51) Int. Cl.
*A47C 7/38* (2006.01)

(52) U.S. Cl.
CPC ..... *A47C 7/38* (2013.01)

(58) Field of Classification Search
CPC ..... A47C 7/38
See application file for complete search history.

(56) References Cited

U.S. PATENT DOCUMENTS 3,738,706 A * 6/1973 Caldemeyer ..... A47C 7/38 297/410
3,877,751 A * 4/1975 Rasmussen ..... A61G 15/125 297/410
3,885,831 A * 5/1975 Rasmussen ..... A61G 15/125 297/410
7,690,729 B2 * 4/2010 Liao ..... A47C 7/38 297/408
10,010,182 B1 * 7/2018 Chen ..... A47C 7/38
2011/0089738 A1 * 4/2011 Jen ..... A47C 7/38 297/404
2012/0139321 A1 * 6/2012 Wu ..... A47C 7/38 297/391

* cited by examiner

*Primary Examiner* — David R Dunn
*Assistant Examiner* — Tania Abraham
(74) *Attorney, Agent, or Firm* — Alan D. Kamrath; Karin L. Williams; Mayer & Williams PC

(57) ABSTRACT

A headrest device includes a headrest support and an adjusting seat. The headrest support is a flat rod and has a ditch and a bias rack beside the ditch. The adjusting seat is being inserted by the headrest support and has a pressing member and a buffer assembly. The pressing member is elastically pivotedly connected into a side of the adjusting seat. Part of the pressing member protrudes from the adjusting seat. The pressing member has hooking teeth corresponding to the bias rack in biasing direction and an elastic arm pressed by the adjusting seat so as to make the pressing member normally elastically outward pushed and swayable. The hooking teeth engages with the bias rack.

16 Claims, 12 Drawing Sheets

HEADREST DEVICE OF OFFICE CHAIR

RELATED APPLICATIONS

This United States Patent Application is a continuation-in-part of U.S. patent application Ser. No. 16/452,476, filed Jun. 25, 2019, hereby incorporated by reference herein.

TECHNICAL FIELD

The invention relates to office chairs, particularly to headrests.

RELATED ART

An adjustment structure of a headrest is mounted on a chairback so that the headrest can be adjusted up and down relative to the chairback. A conventional adjustment structure includes a sliding member, a fixing member and a button member. The sliding member, which is an elongate body extending upward and downward, has a headrest connecting portion connected to the headrest at an upper end thereof. A concave space is on a side surface thereof. A side wall of the concave space is provided with a first teeth row. The fixing member is detachably disposed on the chairback and is composed of a front seat and a rear cover. The front seat has a first sliding slot toward the sliding member. A button slot is disposed on a side wall of the first sliding slot to correspond to the first teeth row of the sliding member. The rear cover has a second sliding slot toward the sliding member. The sliding member is slidably sandwiched between the first sliding slot and the second sliding slot. The button member is elastically movably embedded on the button slot of the fixing member and includes a pressing portion protruding from the front seat, a key portion provided on a side of the pressing portion and extending toward the button slot of the fixing member, a button teeth row disposed on a side of the key portion for corresponding engagement or separation the first teeth row, and an elastic portion for providing an elastic restoring force to the button member after being pressed. When the button member is pressed into the button slot of the fixing member, the button teeth row is moved to leave the first teeth row, so that the sliding member can be vertically moved with respect to the fixing member to synchronously adjust the height position of the headrest. When the sliding member has been adjusted to a new position and the button member is released, the button member is restored by the elastic force of the elastic portion, and the button teeth row is also restored to re-engage with the sliding member, so that and the headrest and the sliding member can be positioned at the new position.

However, the first teeth row and the button teeth row are engaged in a front-and-rear direction. When the button teeth row will restore to the first teeth row after horizontal escaping, the engagement between the button teeth row and the first teeth row can be accomplished only if all teeth must correspond to each other. This engagement is not smooth. Also, the button member must be pressed when the sliding member is adjusted both upward and downward. As a result, a user must leave the chair to adjust the headrest. It is not convenient for users.

SUMMARY OF THE INVENTION

An object of the invention is to provide a headrest device, which allows a user sitting on a chair to directly adjust a position of a headrest of the chair without leaving the chair.

Another object of the invention is to provide a headrest device, which can be rapidly and firmly assembled.

To accomplish the above objects, the headrest device of the invention includes a headrest support and an adjusting seat. The headrest support is a flat rod and has a ditch and a bias rack beside the ditch. The adjusting seat is being inserted by the headrest support and has a pressing member and a buffer assembly. The pressing member is elastically pivotedly connected into a side of the adjusting seat. Part of the pressing member protrudes from the adjusting seat. The pressing member has hooking teeth corresponding to the bias rack in biasing direction and an elastic arm pressed by the adjusting seat so as to make the pressing member normally elastically outward pushed and swayable. The hooking teeth engages with the bias rack.

DETAILED DESCRIPTION OF THE INVENTION

In the following description, the terms "upper", "upward", "top", "vertical", "lower", "bottom", "horizontal" and "downward" about directions or positions are based on a chair which is placed on a floor in a normally usable status.

Figure 1:
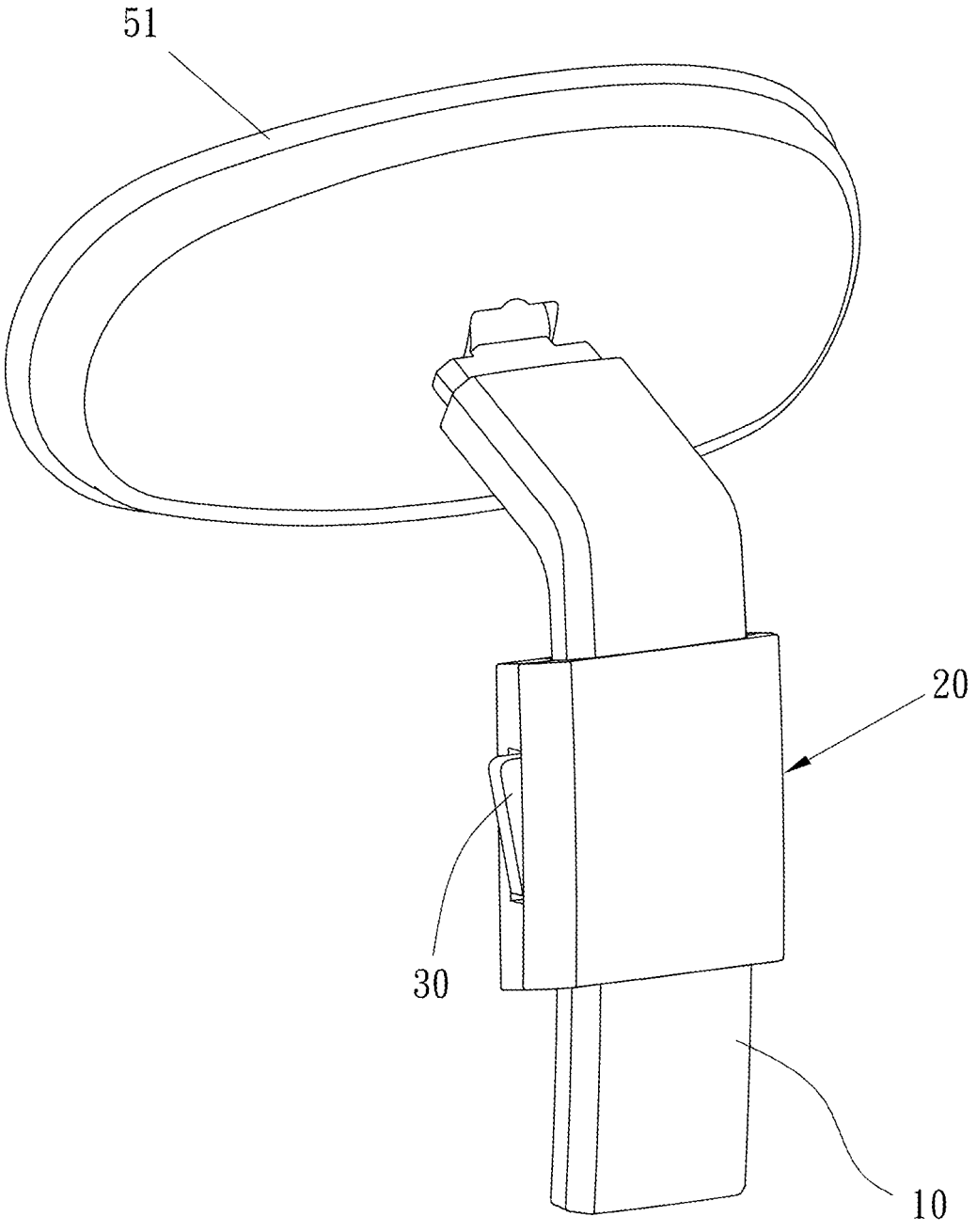
FIG. 1 is an assembled view of the invention.
Figure 2:
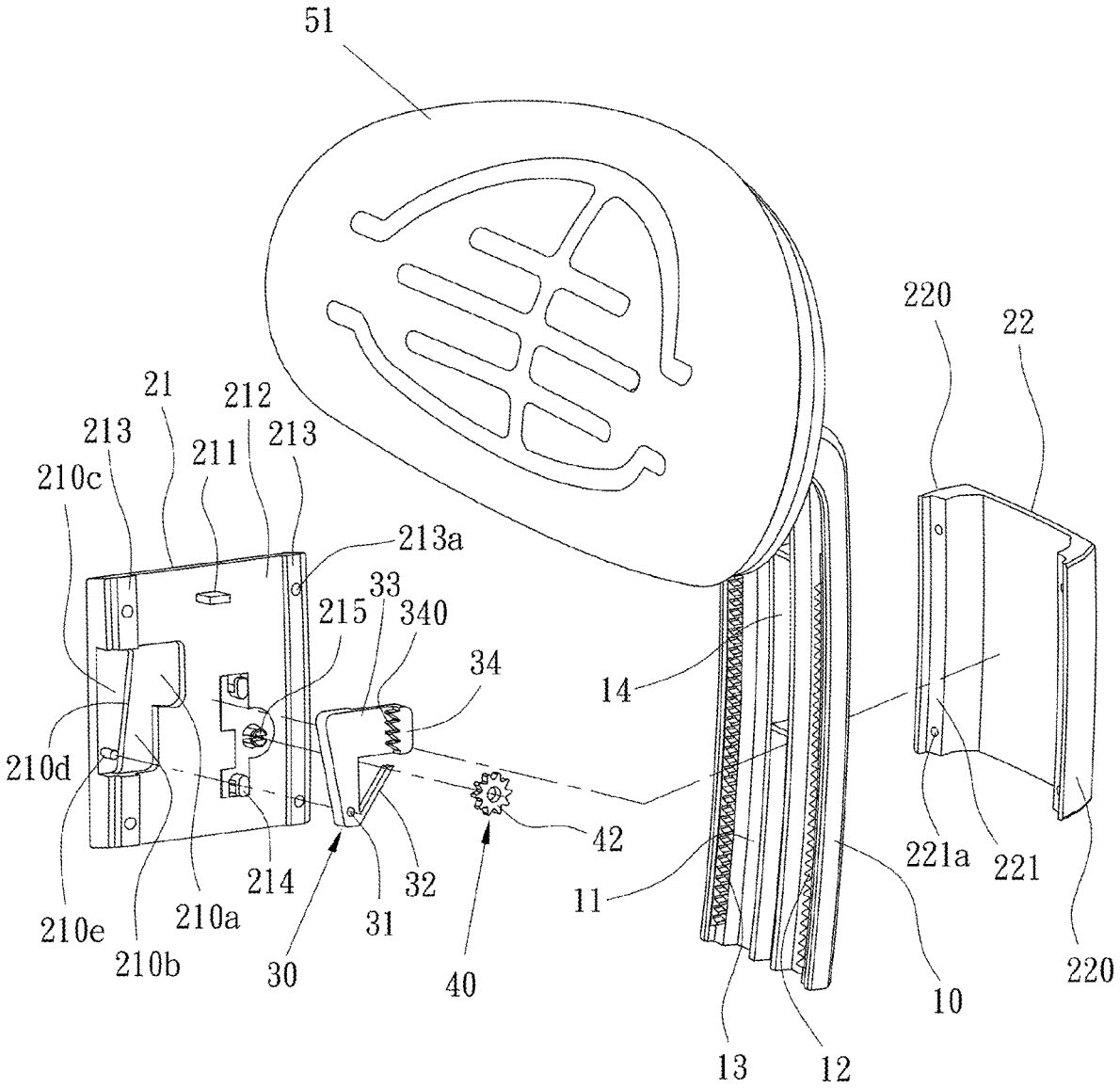
FIG. 2 is an exploded view of the invention.
Figure 3:
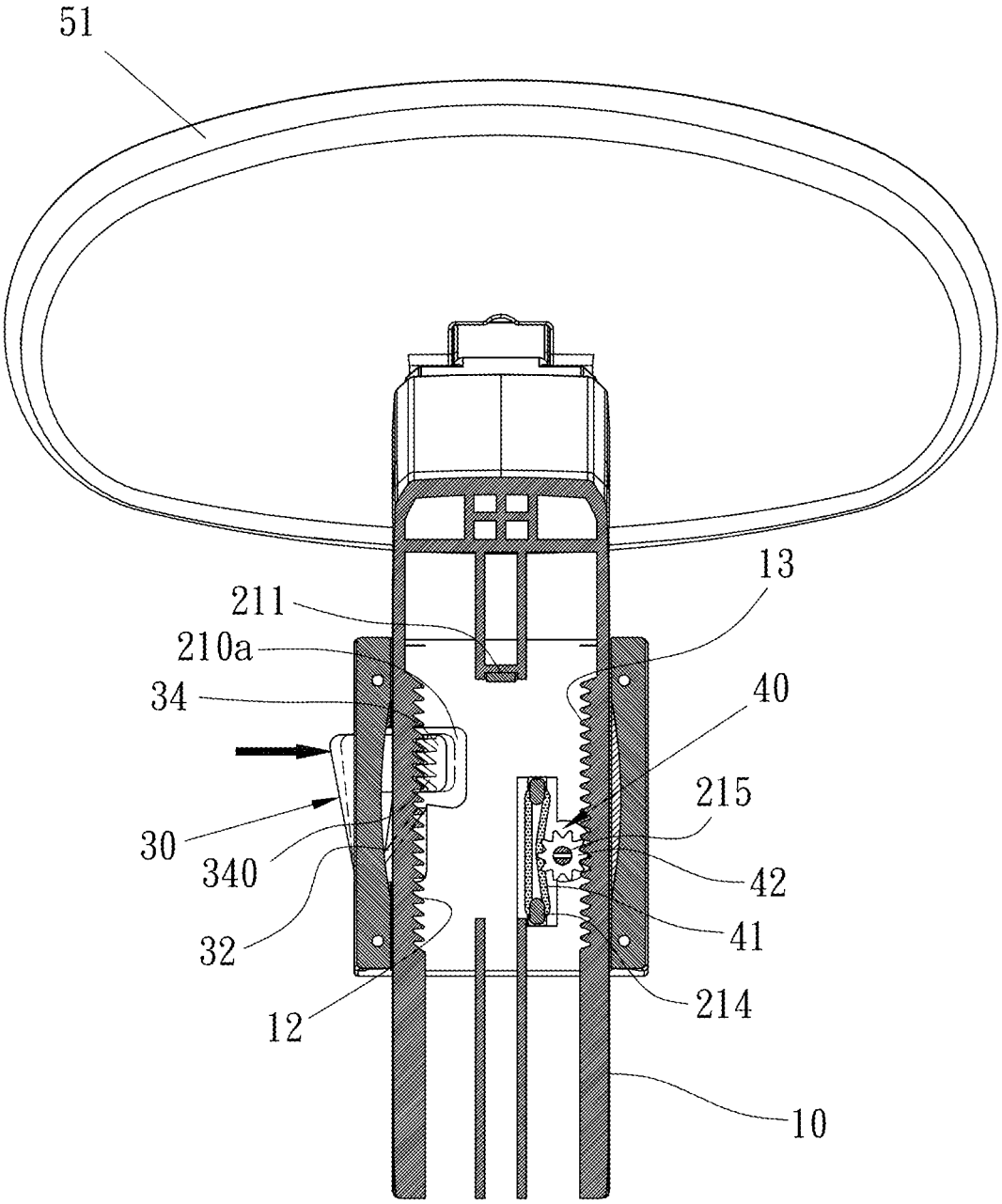
FIG. 3 is a cross-section view of the invention.

Please refer to FIGS. 1-3. The headrest device of the invention includes a headrest support 10 and an adjusting seat 20. The headrest support 10 is a flat rod for supporting a headrest 51 in a substantially vertical direction when the headrest support 10 is mounted on a chairback 70. A front side of the headrest support 10 is provided with a longitudinal ditch 11. A bias rack 12 whose teeth are slant downward and an unbiased rack 13 whose teeth are unbiased or regular are separately provided beside the ditch 11. A longitudinal limiting trench 14 is provided in the ditch 11.

Please refer to FIG. 2. The adjusting seat 20 is being inserted by the headrest support 10 and has a pressing member 30 and a buffer assembly 40, which correspond to the bias rack 12 and the unbiased rack 13, respectively. The adjusting seat 20 includes an inner base 21 and an outer base 22. The inner base 21 and the outer base 22 are correspondingly connected to be adjustably fastened to the headrest support 10.

A side of the inner base 21, which faces the bias rack 12, is formed with a stepped depression 210*a*, 210*b* and a concavity 210*c* beside the stepped depression 210*a*, 210*b*.

An upper portion 210*a* of the stepped depression 210*a*, 210*b* is greater than a lower portion 210*b* of the stepped depression 210*a*, 210*b* in width to form a step. The concavity 210*c* is deeper than the stepped depression 210*a*, 210*b*. A width of the concavity 210*c* tapers toward the bottom and the joint line between the concavity 210*c* and the stepped depression 210*a*, 210*b* is slant. A pivot bar 210*e* is provided in the concavity 210*c* for rotatably connecting the pressing member 30. The buffer assembly 40 is disposed on the inner base 21 beside the unbiased rack 13 to form damping. A protrudent wall 211 is formed on the inner base 21 which can be slid in the limiting trench 14 for limiting the vertical adjustment of the headrest support 10. The inner base 21 has a receiving room 212 for accommodating the headrest support 10. Each of two vertical opposite sides of the inner base 21 is formed with an L-shaped wall 213. Each of two vertical opposite sides of the outer base 22 is formed with a side wall 220 for accommodating the headrest support 10. The top edge of the side wall 220 is formed with a groove 221 correspondingly embedded by the L-shaped wall 213. The grooves 221 and the L-shaped walls 213 are provided with corresponding locking holes 213*a*, 221*a* which can be fastened by bolts.

The pressing member 30 has a pivot hole 31 which is inserted by the pivot bar 210*e* and an elastic arm 32 arranged aslant upward. The elastic arm 32 is blocked by an edge of the lower portion 210*b* of the stepped depression. The pressing member 30 is formed with a protrusion 33 correspondingly received in the upper portion 210*a* of the stepped depression. The stepped depression 210*a* has a leeway for movement of the protrusion 33. The protrusion 33 is further formed with an abutment block 34 toward the headrest support 10. An inner edge of the abutment block 34 is formed with hooking teeth 340 corresponding to the bias rack 12. The hooking teeth 340 are upward biased to engage with the bias rack 12. When the pressing member 30 is pivoted to the pivot bar 210*e*, a part of the pressing member 30 projects from the concavity 210*c*. A slant gap is formed between the pressing member 30 and an inclined inner edge 210*d* of the concavity 210*c* for movement of the pressing member 30.

The buffer assembly 40 includes an elastic member 41 hooked between two hooked bars 214. A positioning bar 215 beside the middle between the two hooked bars 214 is axially connected to a gear 42. The gear 42 is elastically pushed by the elastic member 41 to form damping to the slide of the unbiased rack 13 engaging with the gear 42.

Figure 4:
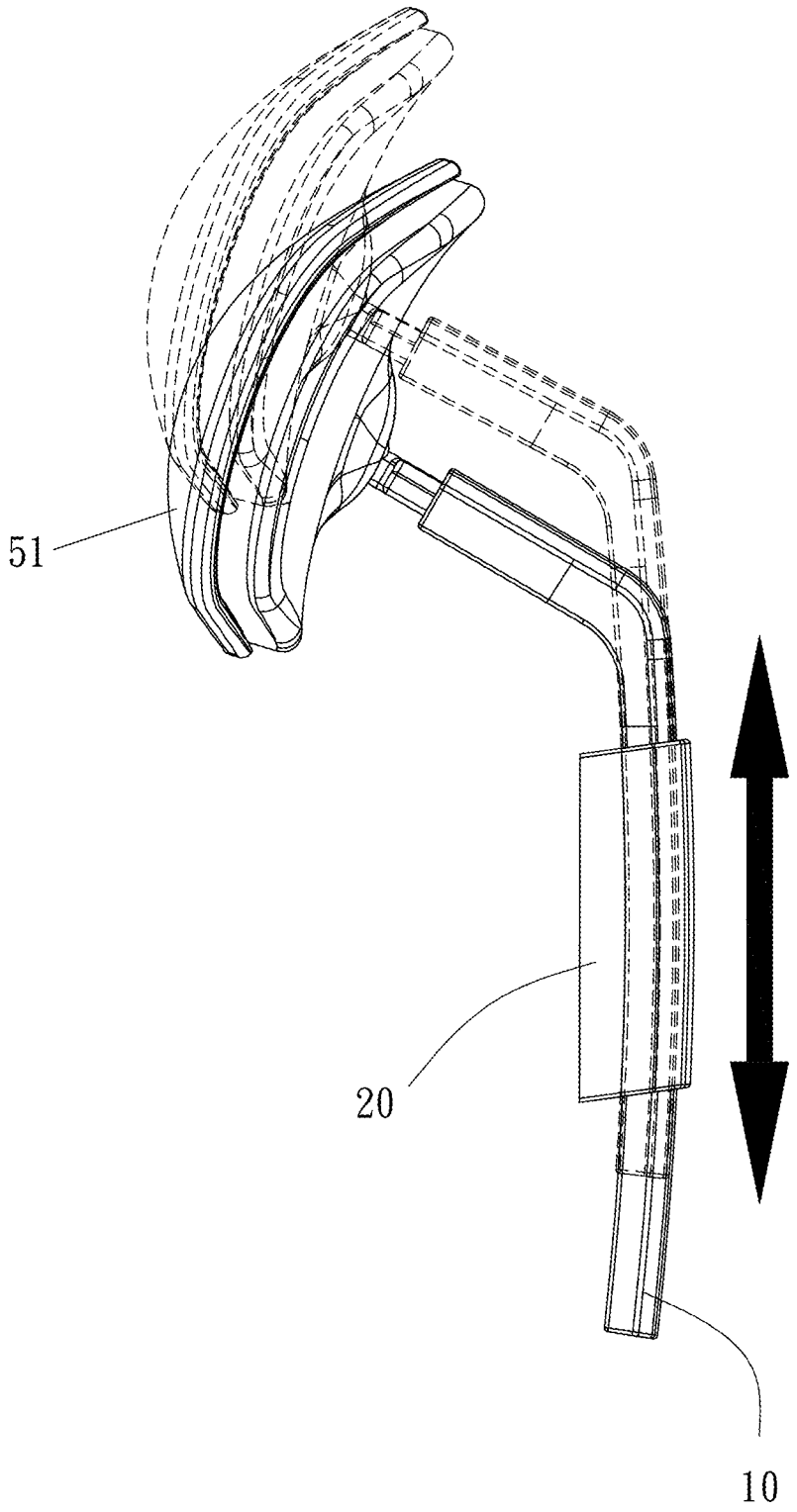
FIG. 4 is a schematic view of elevation of the invention.

Please refer to FIG. 4. When the pressing member 30 is pressed inward, the pressing member 30 is swayed about the pivot bar 210*e* to make the hooking teeth 340 escape from the bias rack 12. As a result, the headrest support 10 can be vertically slid with the limit formed by both the protrudent wall 211 and the limiting trench 14. The pressing member 30 has a normally outward elasticity because of the elastic arm 32. When the headrest support 10 is slid upward, a unidirectional ratchet effect is formed between the bias rack 12 and the hooking teeth 340. In other words, the headrest support 10 can be directly further upward slid without pressing the pressing member 30 and the pressing member 30 will automatically fasten the headrest support 10 when the headrest support 10 has been slid to a desired position. Also, the pressing member 30 has a pendulum movement when the headrest support 10 is being adjusted, this can increase smoothness of the engagement.

Figure 5:
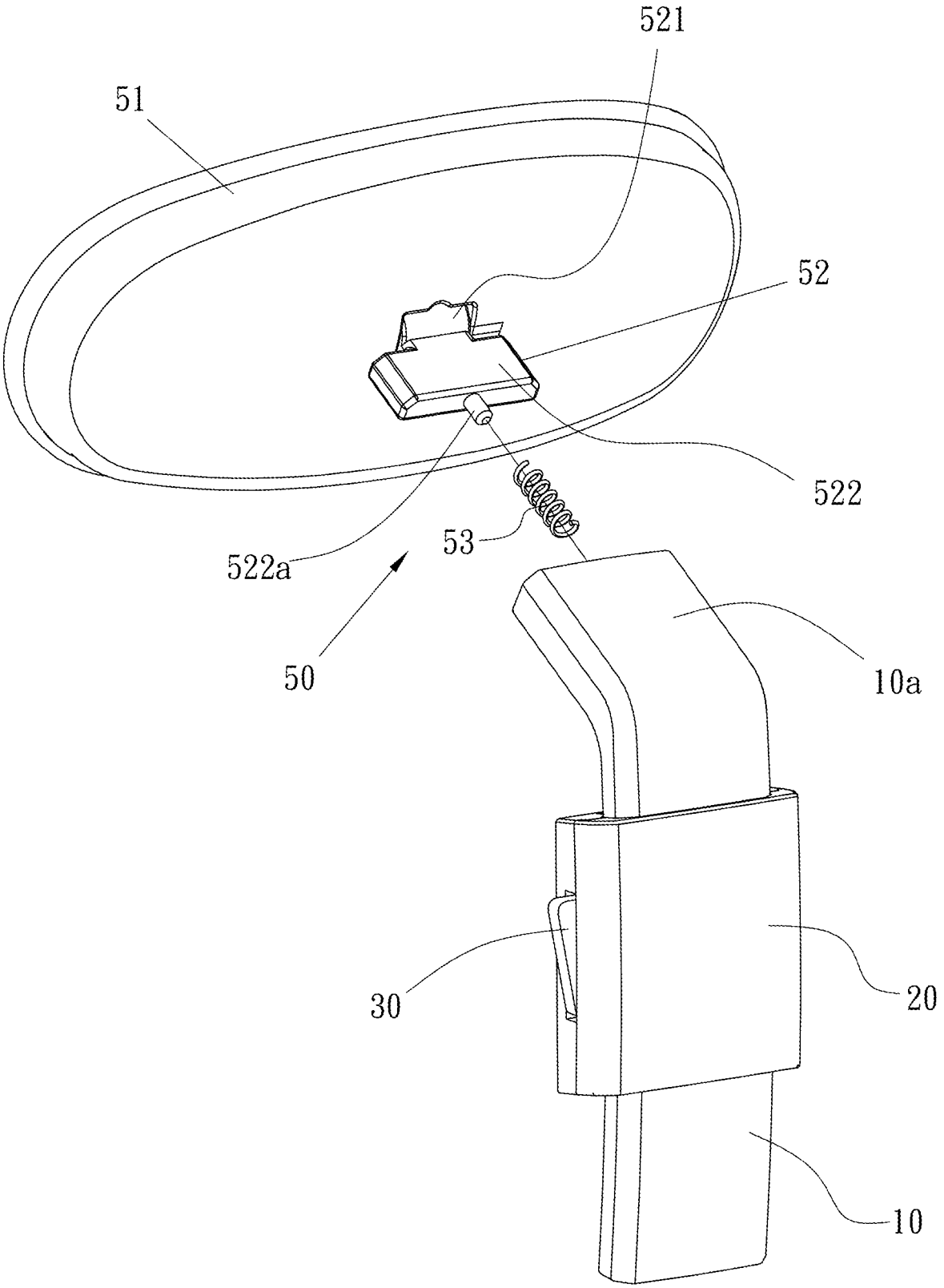
FIG. 5 is a partially exploded view of the invention.
Figure 6:
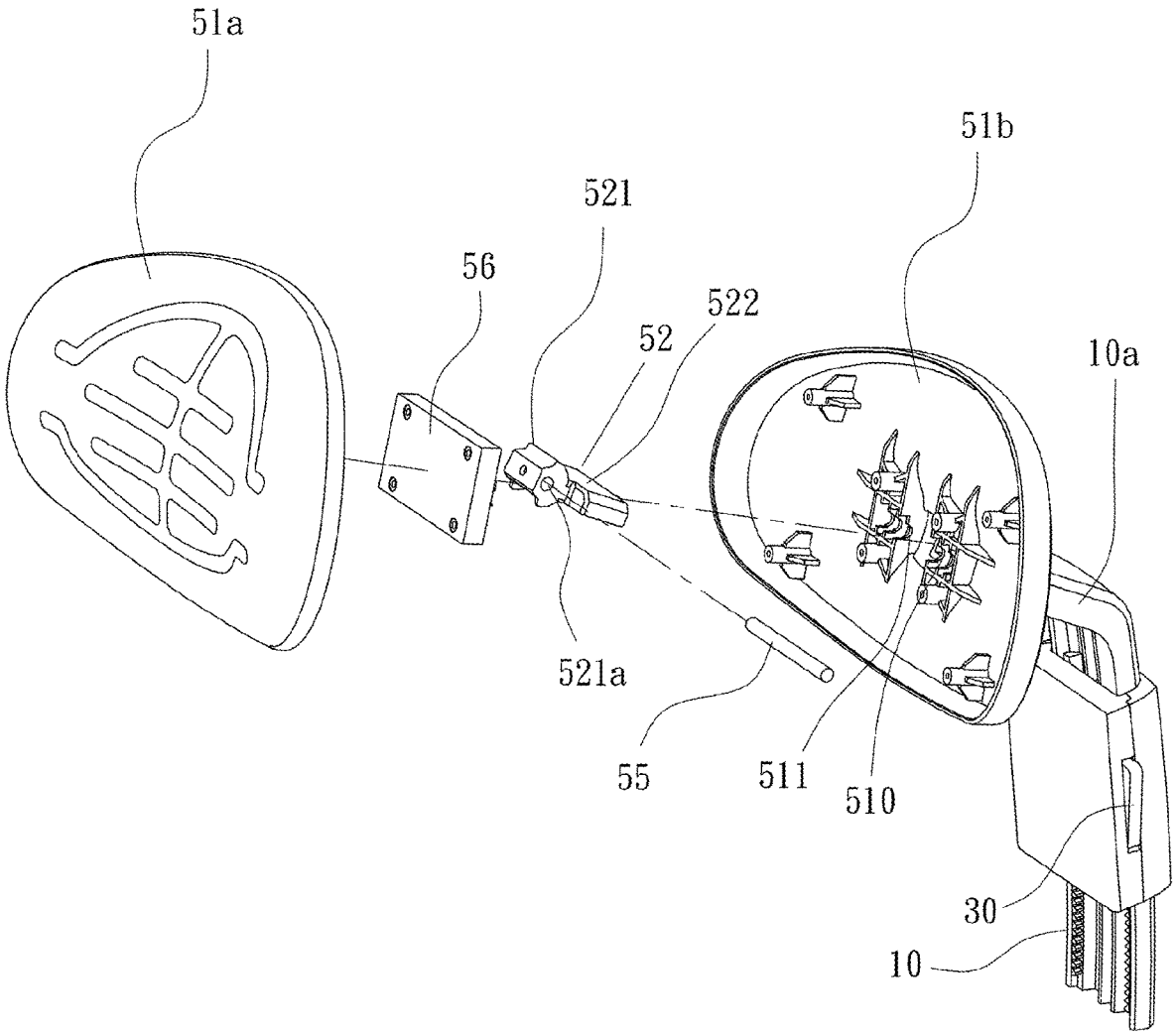
FIG. 6 is another partially exploded view of the invention.
Figure 7:
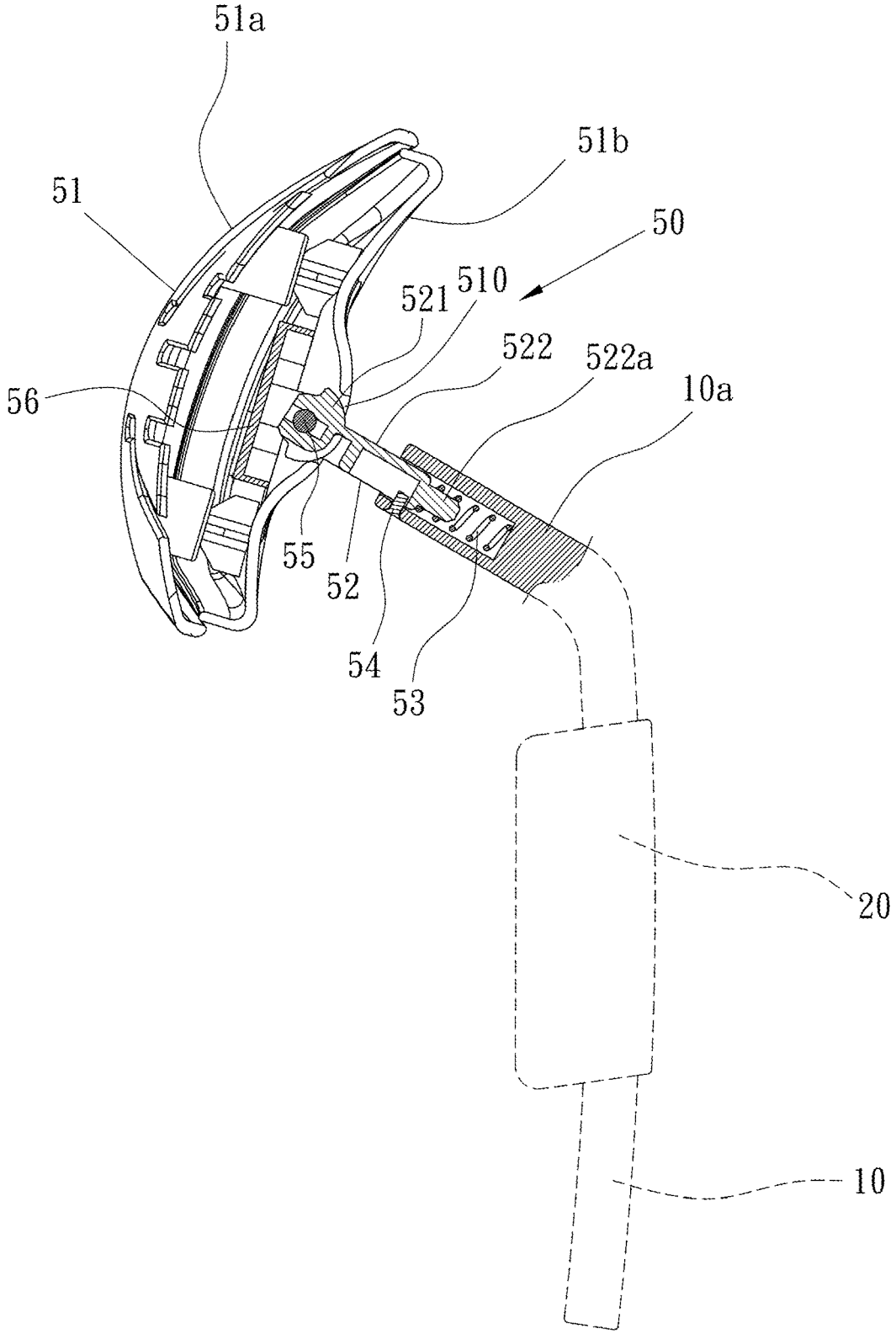
FIG. 7 is a cross-section view of the headrest assembly of the invention.
Figure 8:
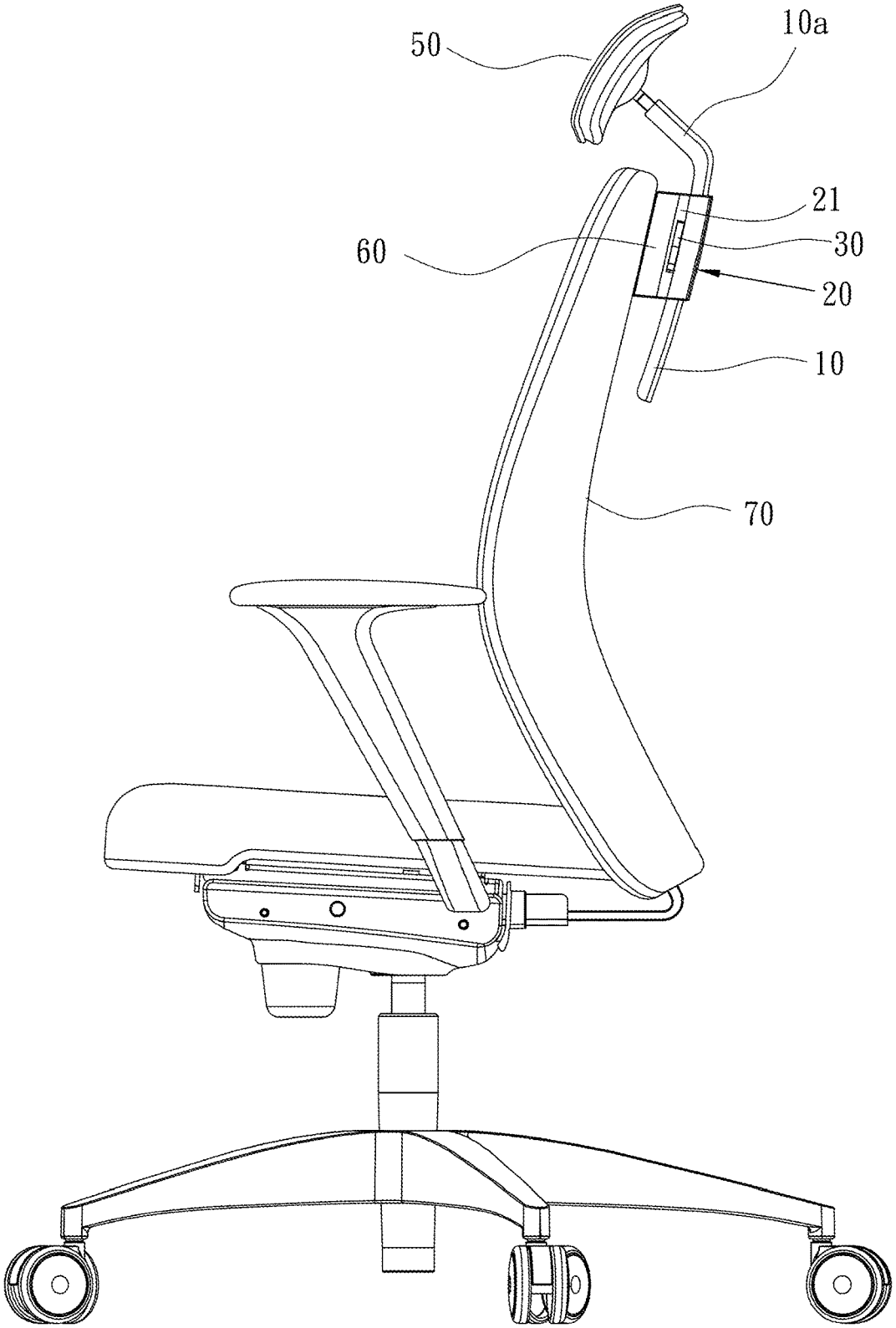
FIG. 8 is a schematic view of the invention assembled to a chair back.
Figure 9:
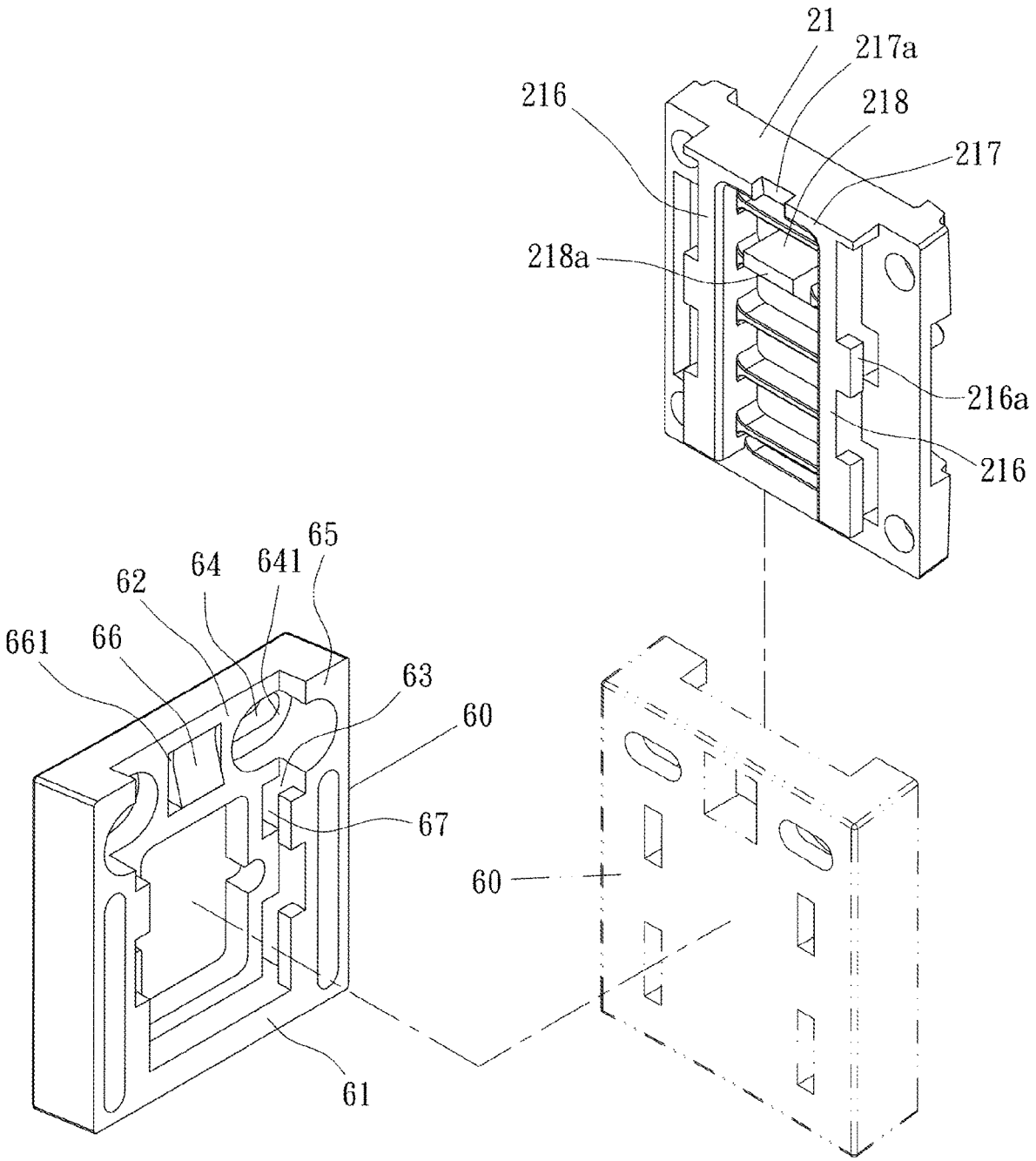
FIG. 9 is an exploded view of the inner base and the fixing seat of the invention.
Figure 10:
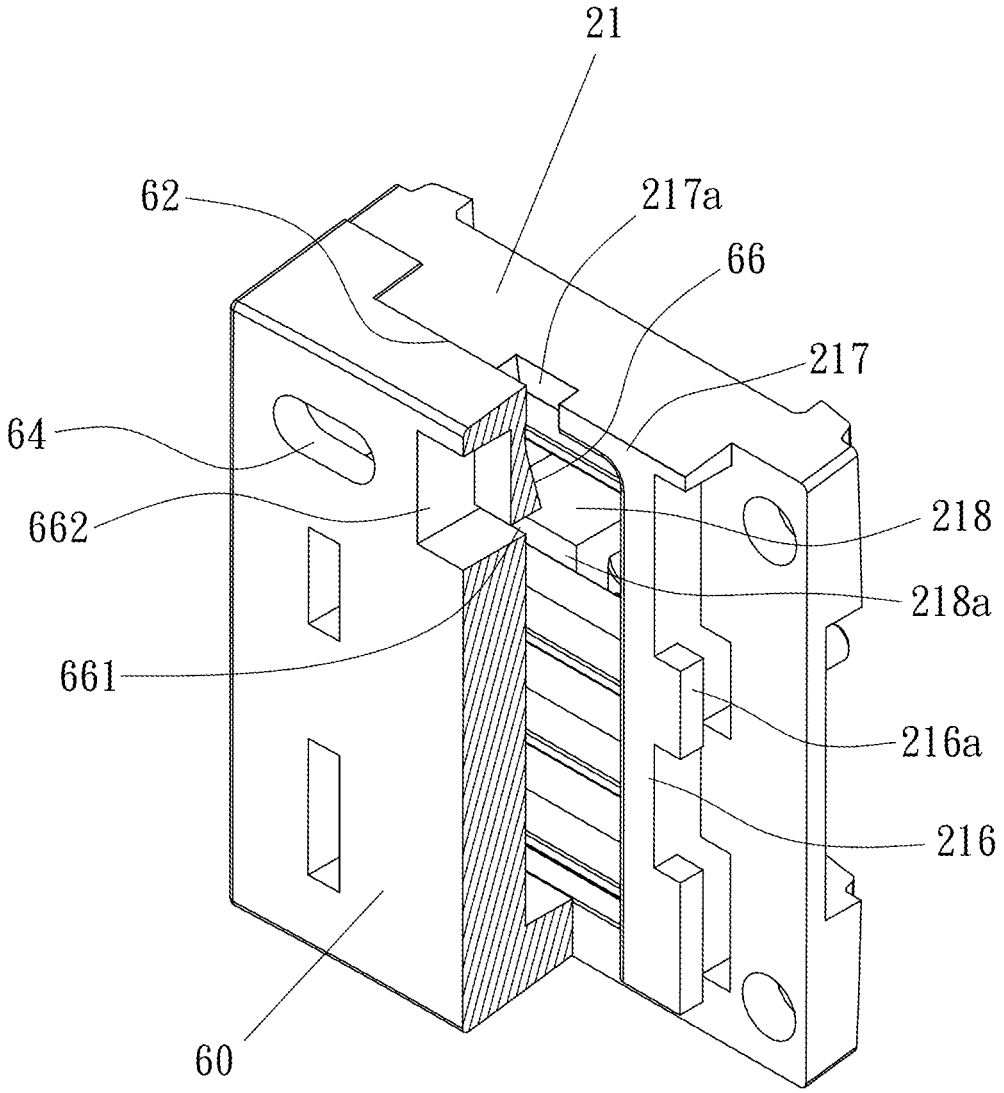
FIG. 10 is a schematic view of the inner base and the fixing seat of the invention.

Please refer to FIGS. 5-7. The headrest device of the invention includes a headrest assembly 50. The headrest assembly 50 has a headrest 51 and a connecting seat 52 pivotedly connected to the headrest 51. The connecting seat 52 can be telescoped into or projected from a connecting tube 10*a* at an upper end of the headrest support 10. An end of the connecting seat 52 is inserted into the connecting tube 10*a* with elastic support from a spring 53. A pivoting end 521 of the connecting seat 52 has a shaft hole 521*a* and an inserting end 522 of the connecting seat 52 has a contour corresponding to the connecting tube 10*a*. The inserting end 522 is extended with a pillar 522*a* around by the spring 53. A hollow is formed in a side of the inserting end 522. The connecting tube 10*a* has a through hole for receiving a fastener 54 to be inserted into the hollow so as to prevent the connecting seat 52 from escaping. The headrest 51 consists of a front rest 51*a* and a rear rest 51*b*. The rear rest 51*b* has an opening 510 for being inserted by the pivoting end 521. A concave pivoting seat 511 is formed beside the opening 510 for supporting a pivot 55 passing the pivoting end 521. The pivoting end 521 and the pivot 55 are sealed by a blocking plate 56. The headrest 51 can be swayed upward or downward and elastically telescoped or projected by the pivoting end 521 and the inserting end 522.

Please refer to FIGS. 8-12. The inner base 21 of the adjusting seat 20 is formed with two parallel vertical rails 216. Each of the two rails 216 is outward extended with an inserting wing 216*a*. Tops of the two rails 216 are formed with a horizontal blocker 217 at a top side of the inner base 21. A width of the blocker 217 is greater than an overall width of the two rails 216. A middle of the blocker 212 is formed with a notch 217*a*. A wall 218 with a trapezoidal cross-section is formed between the two rails 216. A top side of the wall 218 is a flat surface 218*a* which is flush with those of the rails 216.

The fixing seat 60 has a connecting side 61 facing the adjusting seat 20. The connecting side 61 has a recess 62 with a closed bottom edge. Each of two opposite edges of the recess 62 is formed with a trough 63 for slidably receiving the inserting wings 216*a* of the two rails 216. The fixing seat 60 is formed with two fixing holes 64 for being fixed onto a chairback 30. In this embodiment, the fixing holes 64 are located at junctions between the recess 62 and two side bars 65. The fixing hole 64 is formed with a step 641. A flexible arm 66 which downward aslant protrudes toward the adjusting seat 20 is formed between the two fixing holes 64. Two lateral sides and a bottom side of the flexible arm 66 are formed with a U-shaped slot 661 for providing flexibility to the flexible arm 66. The back of the flexible arm 66 is formed with an indent 662 to shrink thickness of the flexible arm 66. The flexible arm 66 can be stopped by the wall 218 to form positioning.

When the adjusting seat 20 is assembled with the fixing seat 60 through the inner base 21, the inserting wings 216*a* are separately inserted into the troughs 63 of the fixing seat 60. The closed bottom edge of the recess 62 and the blocker 212 of the inner base 21 form a bottom stopper and a top stopper, respectively.

Figure 11:
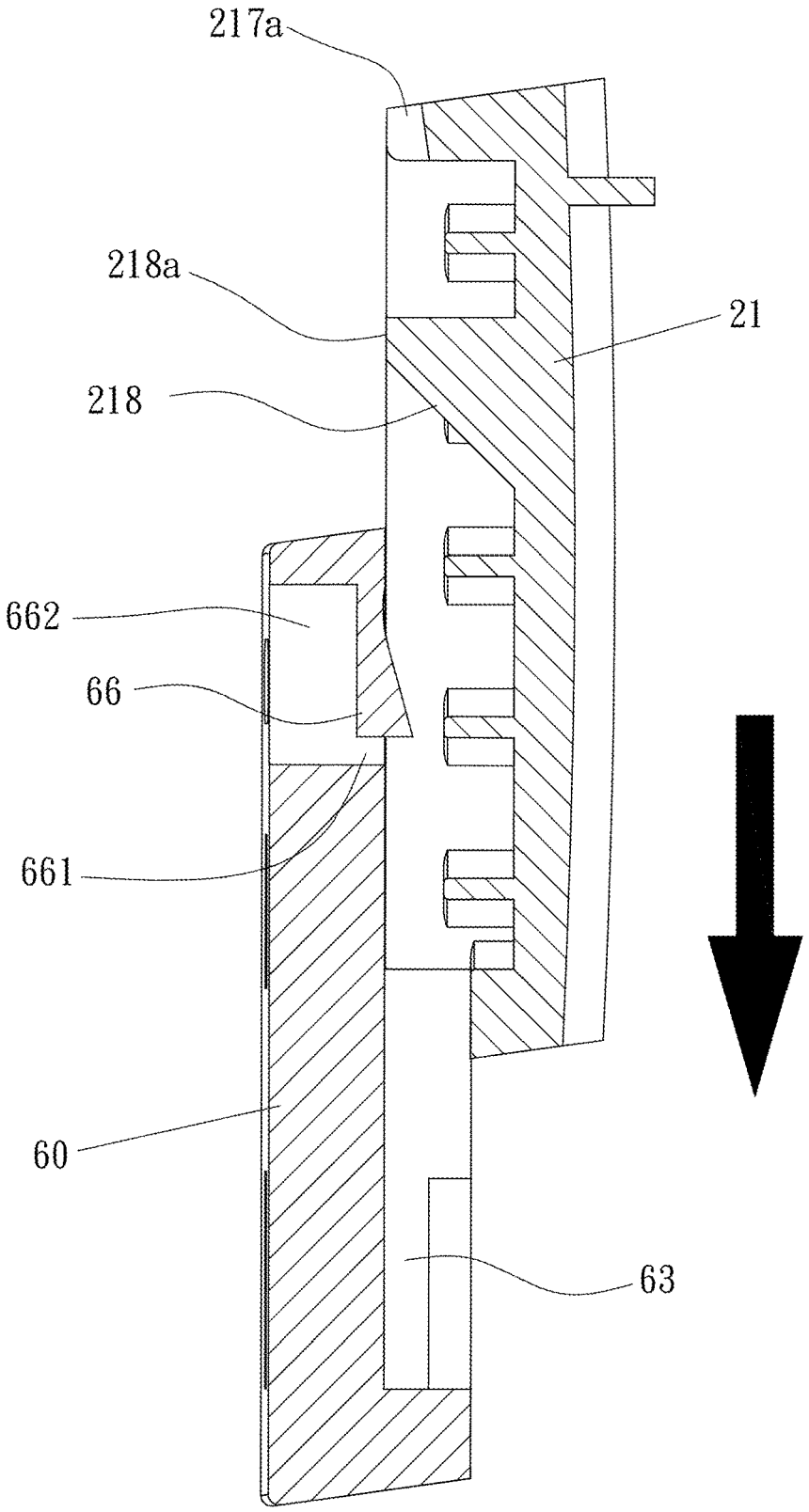
FIG. 11 is a schematic view of the inner base and the fixing seat of the invention, which have not been engaged.
Figure 12:
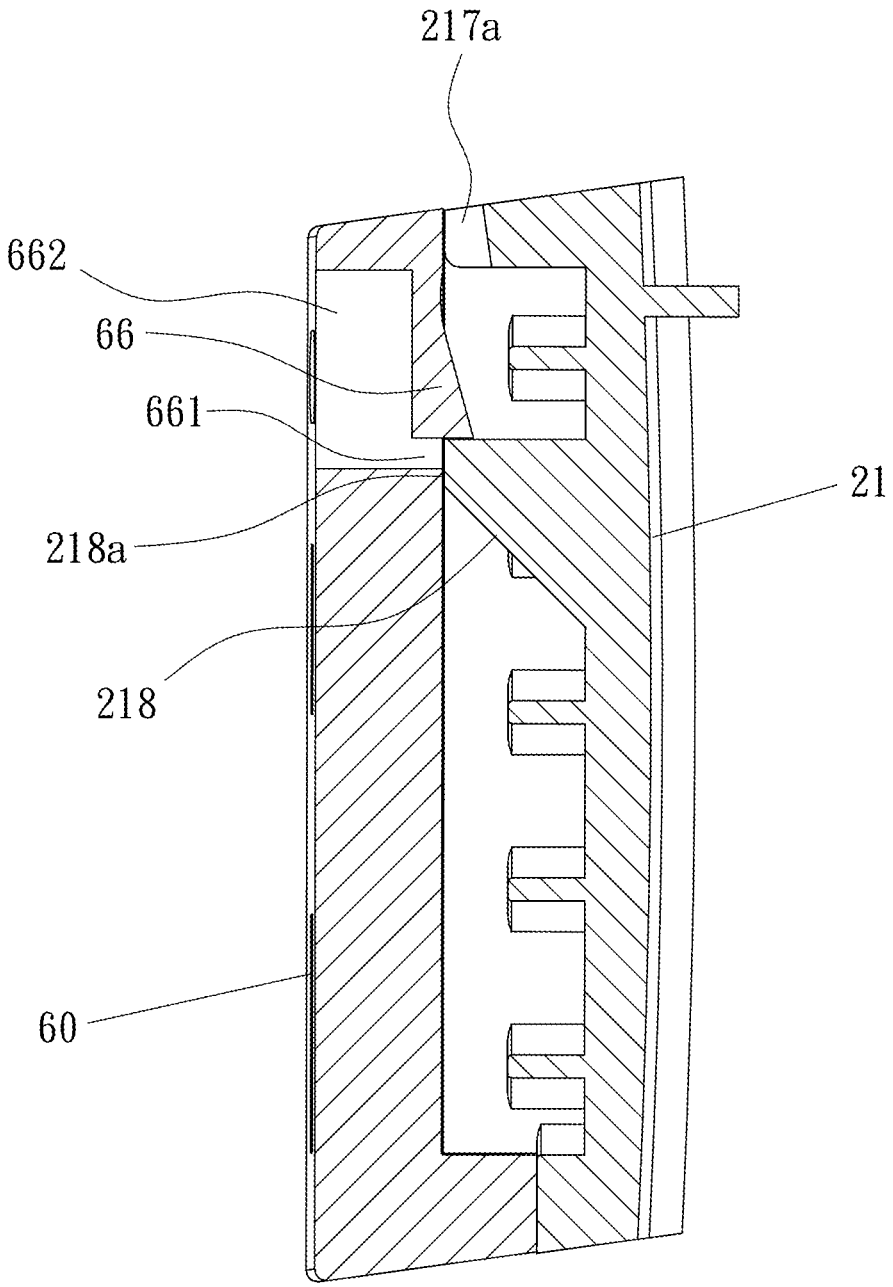
FIG. 12 is a schematic view of the inner base and the fixing seat of the invention, which have been engaged.

Please refer to FIG. 11. When the inner base 21 is being pressed down, the wall 218 will press the flexible arm 66 to make it retracted and the wall 218 will pass the flexible arm 66. When the wall 218 has passed the flexible arm 66, the flexible arm 66 will restore to be stopped by the wall 218. When disassembling, a rod can be inserted into the notch 217*a* to press the flexible arm 66 to release the holding status.

What is claimed is:

1. A headrest device of an office chair, comprising:

a headrest support, being a flat rod, having a ditch and a bias rack beside the ditch; and an adjusting seat, being inserted by the headrest support, having a pressing member and a buffer assembly, the pressing member being elastically pivotedly connected into a side of the adjusting seat, and part of the pressing member protruding from the adjusting seat, the pressing member having hooking teeth corresponding to the bias rack in biasing direction and an elastic arm pressed by the adjusting seat so as to make the pressing member normally elastically outward pushed and swayable, and the hooking teeth engaging with the bias rack, wherein the adjusting seat comprises an inner base and an outer base, and the inner base and the outer base are correspondingly connected to be fastened to the headrest support, wherein the inner base is formed with a stepped depression and a concavity beside the stepped depression, an upper portion of the stepped depression is greater than a lower portion of the stepped depression in width, the concavity is deeper than the stepped depression, a width of the concavity tapers toward the bottom and a joint line between the concavity and the stepped depression is slant, and a pivot bar is provided in the concavity for rotatably connecting the pressing member, and wherein a part of the pressing member projects from the concavity, and a slant gap is formed between the pressing member and an inclined inner edge of the concavity for movement of the pressing member.

2. The headrest device of claim 1, wherein the pressing member has a pivot hole which is inserted by the pivot bar, the elastic arm is blocked by an edge of the lower portion of the stepped depression, the pressing member is formed with a protrusion correspondingly received in the upper portion of the stepped depression, the stepped depression has a leeway for movement of the protrusion, the protrusion is further formed with an abutment block, and an inner edge of the abutment block is formed with hooking teeth corresponding to the bias rack.

3. The headrest device of claim 1, wherein the adjusting seat has a buffer assembly near an edge wall of the ditch.

4. The headrest device of claim 1, wherein a longitudinal limiting trench is provided in the ditch, and a protrudent wall is formed on the inner base which is slidable in the limiting trench.

5. The headrest device of claim 1, wherein the inner base has a receiving room for accommodating the headrest support, each of two vertical opposite sides of the inner base is formed with an L-shaped wall, each of two vertical opposite sides of the outer base is formed with a side wall for accommodating the headrest support, and a top edge of each side wall is formed with a groove correspondingly embedded by the L-shaped wall.

6. The headrest device of claim 5, wherein both the grooves and the L-shaped walls are provided with corresponding locking holes which are fastened by bolts.

7. The headrest device of claim 1, further comprising a headrest assembly, wherein the headrest assembly has a headrest and a connecting seat and a spring, a pivoting end of the connecting seat is pivotedly connected to the headrest, and an inserting end of the connecting seat inserted into a connecting tube at an upper end of the headrest support with elastic support from a spring.

8. The headrest device of claim 7, wherein the pivoting end of the connecting seat has a shaft hole and the inserting end of the connecting seat has a contour corresponding to the connecting tube.

9. The headrest device of claim 8, wherein the inserting end is extended with a pillar around by the spring received in the connecting tube.

10. The headrest device of claim 8, wherein the headrest comprises a front rest and a rear rest, the rear rest has an opening for being inserted by the connecting seat, and a concave pivoting seat is formed beside the opening for supporting a pivot passing the pivoting end.

11. The headrest device of claim 7, wherein the spring is a compression spring.

12. A headrest device of an office chair, comprising:

a headrest support, being a flat rod, having a ditch and a bias rack beside the ditch; and an adjusting seat, being inserted by the headrest support, having a pressing member and a buffer assembly, the pressing member being elastically pivotedly connected into a side of the adjusting seat, and part of the pressing member protruding from the adjusting seat, the pressing member having hooking teeth corresponding to the bias rack in biasing direction and an elastic arm pressed by the adjusting seat so as to make the pressing member normally elastically outward pushed and swayable, and the hooking teeth engaging with the bias rack, wherein the adjusting seat has a buffer assembly near an edge wall of the ditch, and wherein the edge wall of the ditch is an unbiased rack, the buffer assembly comprises an elastic member hooked between two hooked bars, a positioning bar is axially connected to a gear, and the gear is elastically pushed by the elastic member and engages with the unbiased rack.

13. A headrest device of an office chair, comprising:

a headrest support, being a flat rod, having a ditch and a bias rack beside the ditch; and an adjusting seat, being inserted by the headrest support, having a pressing member and a buffer assembly, the pressing member being elastically pivotedly connected into a side of the adjusting seat, and part of the pressing member protruding from the adjusting seat, the pressing member having hooking teeth corresponding to the bias rack in biasing direction and an elastic arm pressed by the adjusting seat so as to make the pressing member normally elastically outward pushed and swayable, and the hooking teeth engaging with the bias rack, wherein the adjusting seat comprises an inner base and an outer base, and the inner base and the outer base are correspondingly connected to be fastened to the headrest support, and wherein the inner base of the adjusting seat is formed with two parallel vertical rails, each of the two rails is outward extended with an inserting wing, tops of the two rails are formed with a horizontal blocker at a top side of the inner base, a width of the blocker is greater than an overall width of the two rails, the blocker is formed with a notch, a wall with a trapezoidal cross-section is formed between the two rails, and a top side of the wall is a flat surface which is flush with those of the rails.

14. The headrest device of claim 13, further comprising a fixing seat, wherein the fixing seat has a connecting side facing the adjusting seat, the connecting side has a recess with a closed bottom edge, each of two opposite edges of the recess is formed with a trough for slidably receiving the inserting wings of the two rails, the fixing seat is formed with two fixing holes for being fixed onto a chairback, a flexible arm which downward aslant protrudes toward the adjusting seat is formed between the two fixing holes, two lateral sides and a bottom side of the flexible arm are formed with a U-shaped slot for providing flexibility to the flexible arm, and the flexible arm is stopped by the wall to form positioning.

15. The headrest device of claim 14, wherein the fixing holes are located at junctions between the recess and two side bars.

16. The headrest device of claim 14, wherein a back of the flexible arm is formed with an indent to shrink thickness of the flexible arm.

* * * * *